US011365099B2

(12) United States Patent
Hausladen et al.

(10) Patent No.: US 11,365,099 B2
(45) Date of Patent: Jun. 21, 2022

(54) ROPE DRUM AND METHOD FOR THE PRODUCTION THEREOF

(71) Applicant: Liebherr-Components Biberach GmbH, Biberach an der Riss (DE)

(72) Inventors: Norbert Hausladen, Biberach (DE); Hubertus Rütten, Riedlingen (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 0 days.

(21) Appl. No.: 16/886,296

(22) Filed: May 28, 2020

(65) Prior Publication Data

US 2020/0339393 A1 Oct. 29, 2020

Related U.S. Application Data

(63) Continuation of application No. PCT/EP2018/082875, filed on Nov. 28, 2018.

(30) Foreign Application Priority Data

Nov. 28, 2017 (DE) ..... 10 2017 128 163.0

(51) Int. Cl.
*B66D 1/30* (2006.01)
*B21H 1/06* (2006.01)
*B21H 3/04* (2006.01)

(52) U.S. Cl.
CPC ..... *B66D 1/30* (2013.01); *B21H 1/06* (2013.01); *B21H 3/04* (2013.01)

(58) Field of Classification Search
CPC ..... Y10T 29/4949; B66D 1/30; B21H 1/06; B21H 3/04–042; B21H 3/048; B21H 3/12
See application file for complete search history.

(56) References Cited

U.S. PATENT DOCUMENTS

| | | | | |
|---|---|---|---|---|
| 1,984,604 A | | 12/1934 | Stahl | |
| 1,991,486 A | | 2/1935 | Bell | |
| 2,420,050 A | | 5/1947 | Maude | |
| 4,084,419 A | * | 4/1978 | Dittrich | B21H 1/06 72/68 |
| 5,085,679 A | * | 2/1992 | Hinze | B21H 1/06 65/515 |

(Continued)

FOREIGN PATENT DOCUMENTS

| | | | |
|---|---|---|---|
| CN | 104649172 A | * | 5/2015 |
| CN | 103072913 | | 8/2015 |
| DE | 393583 | | 4/1924 |

(Continued)

OTHER PUBLICATIONS

Translation of JPH0597395 (Year: 1993).*
Translation of CN104649172 (Year: 2015).*

*Primary Examiner* — Matthew P Travers
(74) *Attorney, Agent, or Firm* — Levine Bagade Han LLP

(57) ABSTRACT

The present invention relates to rope drums for winding and unwinding ropes, having a drum shell, to which end disks are fastened at the end faces, and to rope winches having such rope drums. The invention also relates to a method for producing such a rope drum. According to the invention, the drum shell is seamlessly rolled from an annular workpiece blank by means of a rope groove profile embossed in a non-cutting manner.

8 Claims, 5 Drawing Sheets

(56) References Cited

U.S. PATENT DOCUMENTS

| | | | | |
|---|---|---|---|---|
| 2014/0027691 | A1* | 1/2014 | Ilaka | B66D 1/30<br>254/334 |
| 2020/0306818 | A1* | 10/2020 | Murai | B21B 5/00 |

FOREIGN PATENT DOCUMENTS

| | | |
|---|---|---|
| DE | 3902496 | 8/1990 |
| DE | 10024105 | 4/2003 |
| DE | 10154968 | 10/2003 |
| DE | 202011001845 | 4/2012 |
| DE | 102015119336 | 1/2018 |
| EP | 1528031 | 4/2011 |
| GB | 2490350 | 10/2012 |
| JP | S50-84455 | 7/1975 |
| JP | H05-97395 | 4/1993 |
| WO | WO 2019/106030 | 6/2019 |

* cited by examiner

ROPE DRUM AND METHOD FOR THE PRODUCTION THEREOF

CROSS-REFERENCE TO RELATED APPLICATIONS

This application is a continuation of International Patent Application Number PCT/EP2018/082875 filed Nov. 28, 2018, which claims priority to German Patent Application Number 10 2017 128 163.0 filed Nov. 28, 2017, both of which are incorporated herein by reference in their entireties.

BACKGROUND

The present invention relates to rope drums for winding and unwinding ropes comprising a drum casing to which end plates are fastened at the end faces and to rope winches having such rope drums. The invention further relates to a method of manufacturing such a rope drum.

Rope winches are used in various application areas and substantially comprise three large main assemblies, namely, on the one hand, the rope drum having a drum casing and end plates or guard plates attached to the end face and bounding the drum casing; on the other hand, a drive transmission; and finally a winch frame at which the rope drum is rotatably supported. Said drive transmission is here frequently accommodated in the interior of the rope drum and can, for example, be formed as a single-stage or multi-stage planetary gear.

Such rope winches are used, for example, for charging devices such as lime kiln charging devices or lifting equipment in machine construction and plant construction or in transfer engineering or plants in the mining and extractive industry, wherein the rope winches can serve for vertical material transport, but also as a horizontal feed drive or a slopingly inclined feed drive. Further applications can be cranes such as construction cranes, mobile cranes, or maritime cranes such as harbor cranes, ship cranes, and offshore cranes, with the rope winches here being able to be hoisting winches for winding and unwinding a hoist rope, but also bracing winches for bracing ropes, or also feed winches, for example for traveling a trolley. Such rope winches are furthermore likewise used for other construction machinery such as crawler-mounted cranes and can also be used as derrick winches or deep sea winches.

Depending on the application, such rope winches can be very large, with corresponding large rope winches or heavy duty rope winches being able to have considerable dimensions with diameters of several meters and unit weights of 10 t, 20 t, or even more metric tons.

In this respect, considerable compressive strains under which the rope drum has to hold the rope packet wound on it with sufficient safety occur at the rope drum due to the rope that is to be wound up under load. The rope to be wound is here not only wound in one layer, but is rather stacked over one another on the rope drum in a plurality of layers—also more than ten layers, with every single layer to be wound in turn introducing compressive strains into the rope drum tube so that the compressive strains in the drum casing increase more and more as the number of wound layers increases in accordance with the superposition principle with a rope pull that remains the same per se. If, for example, a rope pull of 100 kN compresses the rope drum tube with a force of approximately 100 kN with a single-layer winding, considerably higher forces acting on the tube result with a plurality of winding layers and can amount to a multiple of said 100 kN and can even exceed 1000 kN with ten or more winding layers.

The drum casing has to withstand this external pressure so that drum wall thicknesses are provided that are considerable in part and drum wall thicknesses of 50-150 mm can, for example, be sensible. The rope drum tubes are in some cases also produced from high strength steels such as heat treatable steel or grain refined steels to save weight, but nevertheless to be able to withstand the high pressure loads.

To be able to efficiently produce large rope drum tubes in said dimensions, metal sheets are typically flame cut, rounded, and welded at the joints. Rope grooving is then mechanically cut into the outer casing surface on these pipes that are produced in this manner to be able to wind up the rope in a controlled manner.

Alternatively to such a welding together of bent metal sheets, the drum casing can also be produced from a drawn pipe. In this manner, however, only rope drums of limited dimensions can be manufactured, with typically only drum diameters up to approximately 700 mm and wall thicknesses up to approximately 50 mm being able to be produced in this manner. The rope grooving is also typically worked into the outer casing surface in a cutting manner with such drawn rope drum tubes.

Starting from this, it is the underlying object of the present invention to provide an improved rope drum, an improved rope winch, and an improved method for manufacturing such a rope drum, to avoid the disadvantages of the prior art, and to further develop the latter in an advantageous manner. A rope drum for large rope winches or heavy duty winches that are subject to fewer restrictions with respect to wall thicknesses, diameters, and material than previously known rope drums should in particular be provided that is simple to produce and that also withstands high pressure strains with sufficient security.

SUMMARY

In accordance with the invention, said object is achieved by a manufacturing method in accordance with claim 1, by a rope drum in accordance with claim 12, and by a rope winch in accordance with claim 21. Preferred embodiments of the invention are the subject of the dependent claims.

It is therefore proposed no longer to draw the drum casing or the rope drum tube or to weld it together from a curved metal sheet, but rather to produce it from one piece seamlessly by rolling and free of joints. In accordance with the invention, the drum casing is seamlessly rolled from an annular workpiece blank. Said annular workpiece blank is shaped by a rolling process to form said drum casing in the required wall thickness and with the required diameter. In this respect, a rope groove profile is formed at the outer casing surface of the drum casing on and/or after the rolling thereof.

Said rope groove profile at the outer casing surface of the seamless drum casing can in particular be formed without cutting by a tool that is mapped in the outer casing surface. The rope groove profile can advantageously be generated by rolling by means of a rolling tool that is mapped in the outer casing surface such as is used in a similar manner in thread rolling.

Very large dimensions and unit weights can be implemented on the one hand without high apparatus costs by rolling the drum casing of the rope winch and by its rope groove profile formed in a non-cutting manner, with the drum diameters and drum wall thicknesses substantially being able to be adapted to the desired design as required. There are in particular no special model costs or mold costs as with cast rope drums or apparatus costs for dies and patrices such as are required in tube drawing. On the other hand, joints and irregularities such as arise in the welding together of bent metal sheets can be avoided and a better force flow and a more even strain development over the total circumference of the drum casing can correspondingly be achieved so that a high stability with respect to pressure loads can be achieved. There is additionally the fact in this respect that no uneven heat input at the circumference of the drum casing occurs due to the dispensing with of weld seams so that a warping of the drum casing and tensions associated therewith can be avoided.

At the same time, the rolling process improves the mechanotechnological properties of the rope drum casing. Structural defects such as a coarse or oriented structure that is, for example, characteristic in tube drawing or also shrinkage cavities that are present in the cast blanks in a manufacturing induced manner can be eliminated by the rolling out. The rolling produces a high degree of shaping and homogenizes the structure composition. A uniform, fine structure largely free of defects such as shrinkage cavities can in particular be produced that is considerably more even, finer, and provided with fewer shrinkage cavities in comparison with a cast or drawn rope drum.

The drum casing can in particular also be manufactured from non-weldable steels since joints no longer have to be welded together due to the rolling of the drum casing. Nevertheless, in dependence on the application, weldable steels can also be used and can be rolled to form the drum casing. The rolling in particular permits a great variety of the usable materials.

In a further development of the invention, the annular blank can be pressure formed at the casing surface side on rolling with a main roll and with a mandrel roll that bound a radial roll gap between them while rotating the annular blank about a blank axis of rotation. Said main roll and mandrel roll can here be positioned toward one another or their distance from one another can be set by a feed drive to be able to set said radial roll gap and to apply the shaping pressure required for the roll shaping. At the same time, the desired wall thickness of the drum casing can be set by the setting of said radial roll gap.

In addition to said main roll and mandrel roll, the annular blank can be pressure formed at the end face side by means of at least one pair of axial rolls that bound an axial roll gap between them and shape or form the end faces of the created drum casing.

Said axial rolls can be conical to bound an axial roll gap between them that is V-shaped or wedge-shaped viewed in cross-section.

A tangential material flow whereby the ring diameter increases is adopted due to the roll shaping by means of said main roll and mandrel roll and said axial rolls and the reduction of the wall thickness and of the ring height hereby achieved. To be able to evade the ring diameter increase, the axial structure can be positioned with the two axial rolls or conical rolls radially along the longitudinal machine axis that can be formed by the axis of the main roll and mandrel roll and the longitudinal axis of the axial rolls.

Said rope groove profile can optionally be reworked in a cutting manner. The rope groove profile can in particular be cut or recut into the outer casing surface by rotation.

In an advantageous further development of the invention, a rising region for the rope to be wound is provided at the end sections of the drum casing, which rising region allows the rope to rise into the next winding layer and to run back in the next winding layer on or before the running against the guard plate. This rising region can advantageously also be formed simultaneously with the rolling of the drum casing so that no further production step is necessary. Alternatively, said rising region can be formed after the rolling of the casing body by a further subsequent non-cutting machining at the outer casing surface, for example by a subsequent rolling step and/or a different non-cutting shaping step by means of which the end section is shaped at the marginal side to form the rising region.

Alternatively to such an integrally one-piece molding of the rising region to the drum casing, the rising region can, however, also be formed as a separate component that is subsequently joined to the seamless drum casing. A joining area can advantageously be molded to the seamless drum casing for such a separate rising element, in particular simultaneously with the rolling of the drum casing or optionally also in a further machining step following on from the rolling procedure.

Said end plates of the rope drum are advantageously formed separately and are subsequently joined to the drum casing, for example screwed on there.

The forming of the drum casing can particularly advantageously be in the form of a seamless, joint-free roll profile in connection with large drum casing diameters of, for example, more than 0.75 m and wall thicknesses of more than 60 mm. The drum casing can in particular also have diameters of more than 1 m or also of several meters. The wall thicknesses can also be considerably larger than the previously named 60 mm, for example more than 74 mm or also more than 100 mm, with drum wall thicknesses of 150 mm or more also being able to be produced.

The wall thickness of the drum casing can advantageously be considerably larger than the depth of the rope grooving in the outer casing surface. If the drum casing, for example, has the previously named smooth inner casing surface, the wall thickness of the drum casing, measured between the smooth inner casing surface and the base of the rope grooves in the outer casing surface, which corresponds to a minimal wall thickness, can amount to more than 150% or more than 200% or also more than 300% or more than 400% of the depth of the rope grooves.

BRIEF DESCRIPTION OF THE DRAWINGS

The invention will be explained in more detail in the following with reference to a preferred embodiment and to associated drawings. There are shown in the drawings.

DETAILED DESCRIPTION

Figure 1:
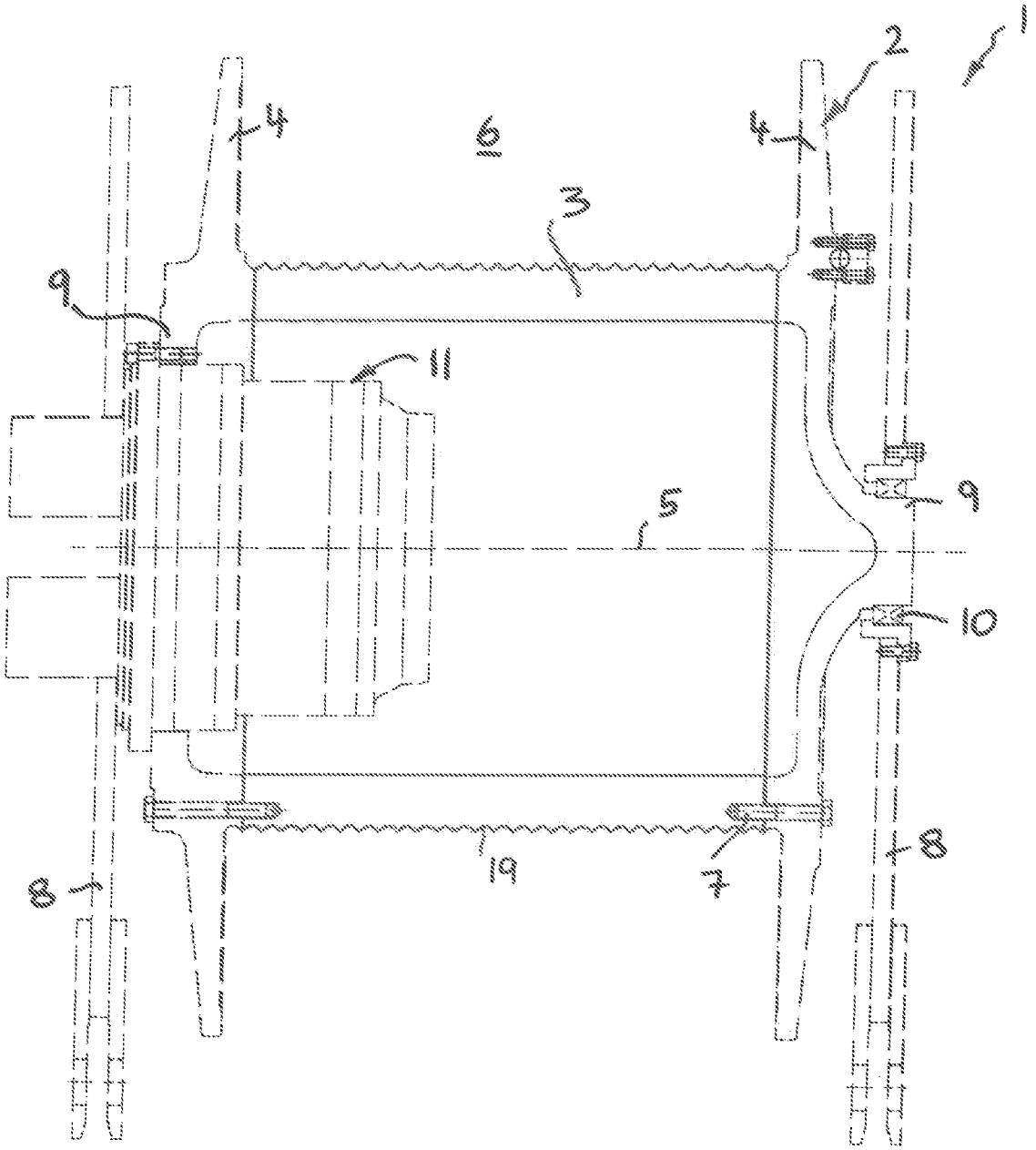
FIG. 1: a schematic front view of a rope winch having a rope drum in accordance with an advantageous embodiment of the invention, with the rope drum being rotatably supported at a winch frame and with a drive transmission being received in the interior of the rope drum.

As FIG. 1 shows, the rope winch 1 comprises a rope drum 2 that has an at least approximately cylindrical drum casing 3 and two end plates 4 that extend transversely to the longitudinal axis 5 of the drum casing 3, that adjoin the drum casing 3 at the end face, and that project radially over the drum casing 3 to laterally bound the winding space 6 above the outer circumference of the drum casing 3.

Said end plates 4 are in particular rigidly fastened to the drum casing 3 at the end face, with said end plates 4 advantageously being able to be formed separately from the drum casing 3 and being able to be fastened thereto in a shape matched or force transmitting manner, for example by means of stud bolts 7 by means of which the end plates 4 can be fixedly screwed to the end faces of the drum casing 3.

Said rope drum 2 can here be rotatably supported at a winch frame 8, with the end plates 4 advantageously having support sections 9 by means of which the rope drum 2 is rotatably supported at the winch frame 8, for example by means of roller element bearings 10.

To drive the rope drum 2, the rope winch 1 can have a drive transmission 11 that can be at least partially received in the interior of the rope drum 2 and/or can extend through one of the end plates 4. Said drive transmission 11 can, for example, be a single-stage or multi-stage planetary transmission.

A winch drive, for example in the form of a hydraulic motor or of an electric motor, can be connected to said drive transmission 11 to be able to rotationally drive the rope drum 2 about the longitudinal axis 5 of the drum casing 3 an/or to be able to provide a desired braking torque on the withdrawing of the rope from the rope drum 2, with a suitable braking device also being able to be provided for this purpose.

The rope drum 2 can be formed in very large dimensions, for example can have a diameter of several meters and/or a drum wall thickness of 100 mm and more, optionally also several hundred millimeters.

Figure 2:
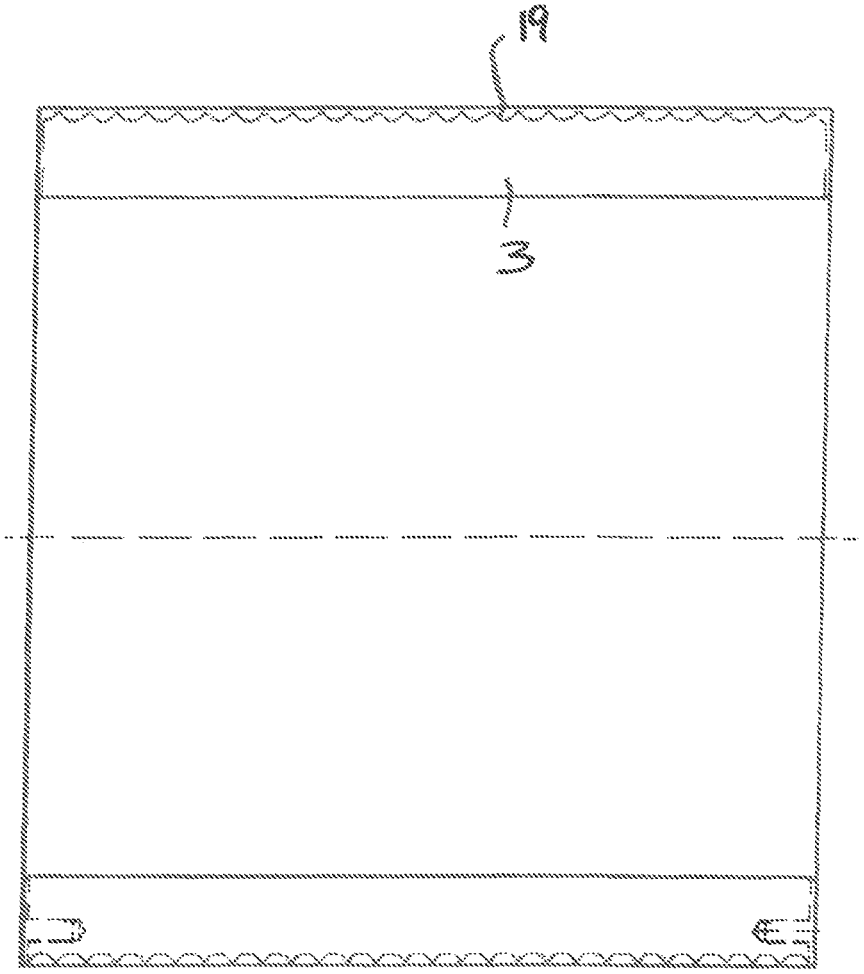
FIG. 2: a schematic sectional view of the drum casing of the rope drum of FIG. 1.
Figure 3:
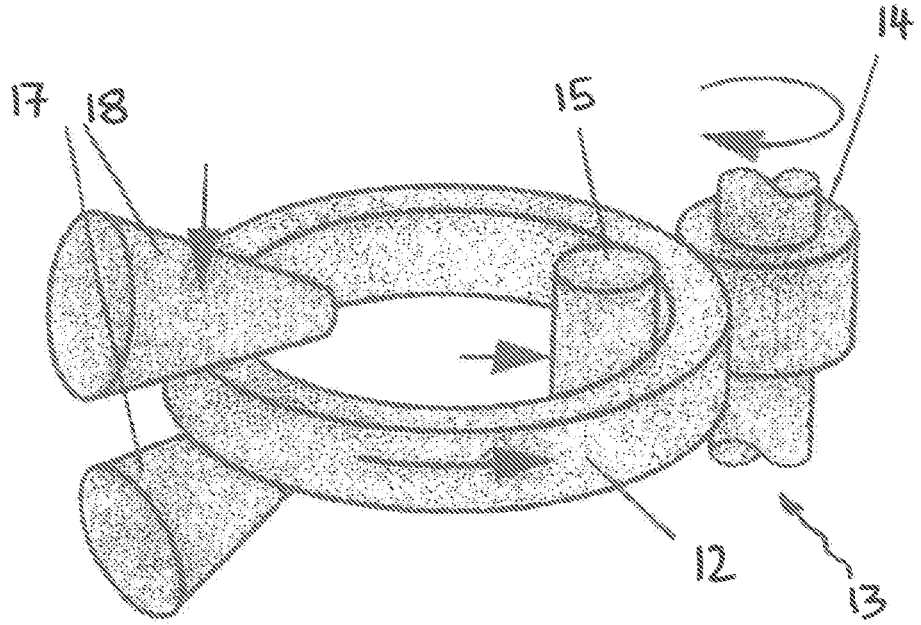
FIG. 3: a schematic representation of a rolling apparatus for rolling the drum casing of the rope drum of the preceding Figures, with the radial and axial load on a rotating, annular workpiece blank by main and mandrel rolls and by a pair of axial rolls being shown.

As FIGS. 2 and 3 show, the drum casing 3 of the rope drum 2 is formed as a seamless, joint-free roll profile that can be established by rolling an annular workpiece blank 12. The rolling apparatus 13 can here be formed in the manner of an annular rolling mechanism and/or can advantageously have a main roll 14 and a mandrel roll 15 that bound a radial roll gap between them whose gap width can, for example be set by delivering the mandrel roll 15. The workpiece blank 12, that is sometimes also called a tube blank, can be loaded with pressure and shaped at the casing surface side by delivering the mandrel roll 15 to the main roll 14. In this respect, one of said rolls, for example the main roll 14, can be rotationally driven so that the annular workpiece blank 12 rotates through the radial roll gap and rotates about its workpiece rotational axis while the rolling procedure is carried out. The mandrel roll 15 can optionally also be driven alternatively or additionally to said main roll 14.

The workpiece blank 12 can originally be an already single-piece cast blank that can already be formed in annular shape or can be provided with a hole or formed into annular shape by a mandrel roll step and/or a forge step.

Said main and mandrel rolls 14 and 15 can be substantially cylindrical and can be arranged in parallel with one another so that the radial roll gap has a gap width that is substantially unchanging over its height.

In addition to said main and mandrel rolls 14 and 15, the workpiece blank 12 can be acted on at the end face by at least one pair of axial rolls 17 during the rolling procedure to be able to shape or form the end faces of the drum casing 2 being formed.

Said axial rolls 17 and 18 can each be conical and can taper toward the center of the annular workpiece blank 12, with the rotational axes of the two axial rolls 17 and 18 being able to be arranged in a common plane that can pass through the two aforesaid mandrel and main rolls 14 and 15. In other words, the axial roll pair 17, 18 can be disposed opposite the main and mandrel rolls 14 and 15 or can act on an annular section of the workpiece blank 12 that is disposed opposite the annular section acted on by the mandrel and main rolls.

At least one axial roll of the two axial rolls 17 and 18 can be set in the axial direction toward the other axial roll to be able to exert pressure on the end faces of the workpiece blank 12. At the same time, the produced length of the drum casing can be controlled by adjusting the spacing of the axial rolls 17, 18 from one another.

After the rolling of the drum casing 3, i.e. after the shaping of the workpiece blank 12 by rolling toward the drum casing 3, or also simultaneously with the rolling, a rope groove profile 19 can be formed at the outer casing surface 3*a* of the drum casing 3, as FIG. 3 shows. Said rope groove profile 19 can be formed by non-cutting shaping, for example by a rolling tool that is mapped in the outer casing surface and is formed in a similar manner to said rope groove profile on thread rolling.

Figure 4:
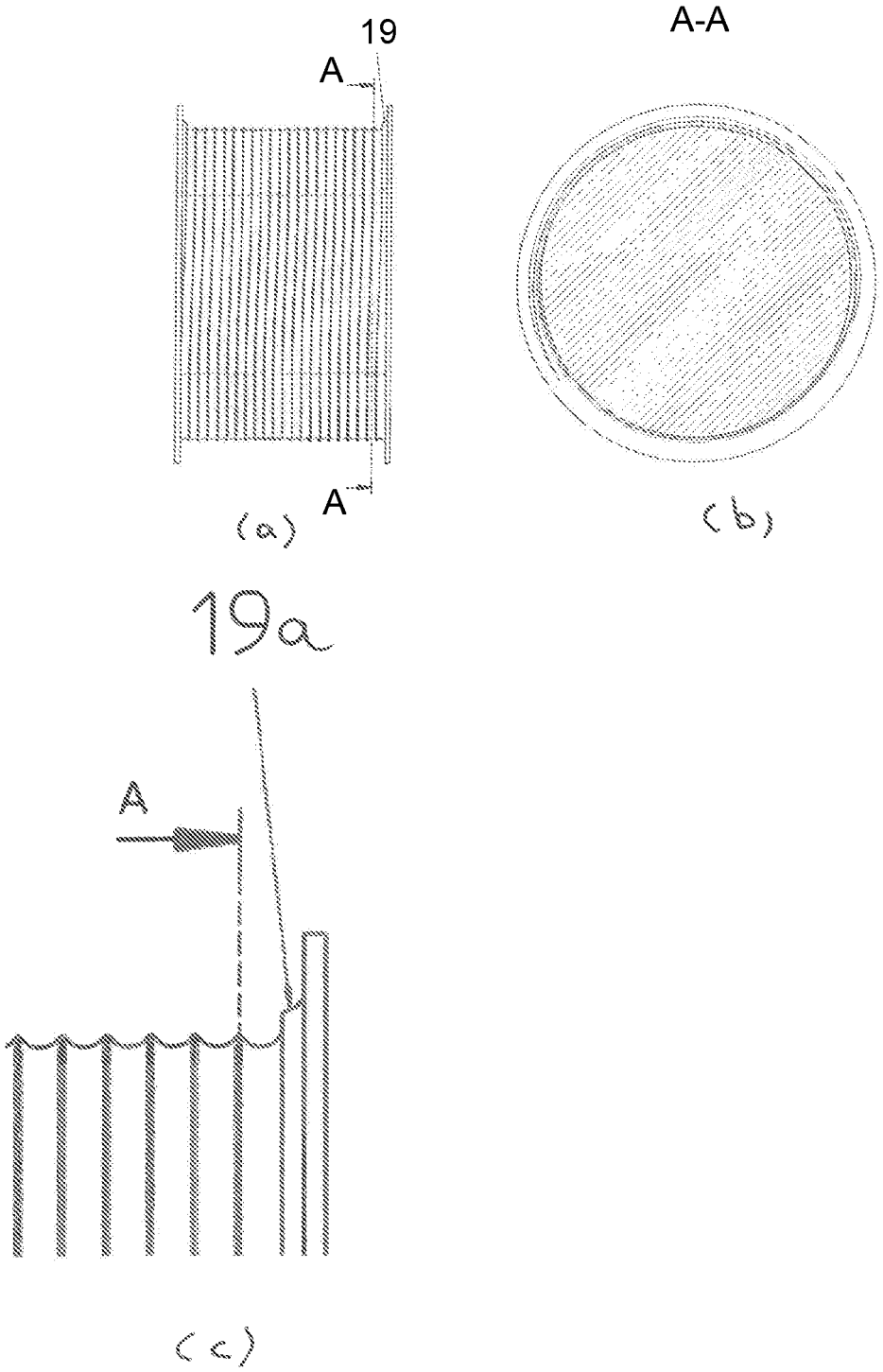
FIG. 4: a further view of the drum casing of the rope drum of the preceding Figures, with the partial view a being a plan view of the outer casing surface of the drum casing and showing its rising regions at the end side, partial view b being a sectional view along the line A-A in partial view a and showing the contouring of the rising region in the circumferential direction of the drum casing, with partial view c further being a sectional, enlarged representation of said rising region, and partial view d being a sectional, enlarged sectional view of the drum casing that illustrates the ratio of the depth of the rope groove profile to the wall thickness of the drum casing.

As FIG. 4, in particular its partial views a to c, shows, a respective rising region 19*a* can be molded to end sections of the drum casing 3 that rises continuously viewed in the circumferential direction, cf. partial view 4*b*, to allow the rope running up on it to rise and to allow it to run back in the next winding layer.

Said rising region 19*a* can advantageously also be formed during the rolling of the drum casing 3 so that said rising region 19 is molded integrally in one piece to the drum casing 3 and is formed by a section of the seamlessly formed roller profile.

Said rising region 19*a* can in particular adjoin the rope groove profile 19 seamlessly and/or without a step so that the rope running in the last rope groove runs harmoniously onto the rising region 19*a* and is raised to the next winding layer by its upward slope in the circumferential direction of the drum casing.

Figure 5:
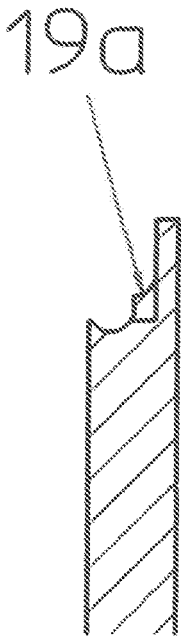
FIG. 5: a sectionally enlarged representation of the rising region of the drum casing similar to partial view c of FIG. 4, with the rising region being formed in a further embodiment of the invention as a separate component subsequently joined to the drum casing.

As FIG. 5 shows, said rising region 19*a* can, however, also be formed as a separate element that is subsequently joined to the seamlessly rolled drum casing 3. Said separate part can form the total rising region 19*a* or also only a section thereof.

The separate rising part is advantageously seated on the outer casing surface of the drum casing 3, with the drum casing 3 being able to have a suitably formed joining surface, in particular an annular or partially annular surface, to which the rising region can be joined. The drum casing can advantageously also have an end-face contact surface for said rising region to avoid a lateral pressing away of the separate element, cf. FIG. 5.

The joining surface formed at the drum casing 3 for the separate rising element can be formed in a non-cutting manner at the drum casing and can in particular also be formed during rolling.

As partial view d of FIG. 4 shows, the wall thickness of the drum casing 3 can be considerably larger than the depth of the rope grooves of the rope groove profile 19. The minimal wall thickness x, measured from the smooth inner casing surface to the base of the rope grooves, can, for example, amount to more than 200% or more than 300% of the depth y-x of the rope grooves 19.

The contour of the inner casing surface can differ from the contour of the outer casing surface having the rope groove profile and does not have to follow it. The inner casing surface of the drum casing 3 can in particular be smooth and can in particular be at least approximately cylindrical.

We claim:

1. A method of manufacturing a rope drum comprising a drum casing and end plates attached thereto at an end face, the method comprising:

seamlessly rolling the drum casing from an annular workpiece blank by a rolling apparatus, forming a rope groove profile at an outer casing surface of the drum casing during and/or after the seamlessly rolling of the drum casing, wherein forming the rope groove profile at the outer casing surface of the drum casing comprises non-cutting machining the rope groove profile by a tool that is mapped in the outer casing surface, forming a rising region for a rope by a rolling process at the outer casing surface at at least one end section of the drum casing, and further forming the rising region by joining a separate part to an annular joining surface formed by the rolling process.

2. The method of claim 1, wherein forming the rope groove profile at the outer casing surface of the drum casing further comprises rolling a rolling tool that is mapped in the outer casing surface.

3. The method of claim 1, wherein an inner casing surface of the drum casing is formed as smooth and/or without a groove profile so that when the drum casing is viewed in cross-section, a wall thickness of the drum casing is cyclically thinner and thicker between the inner casing surface and the outer casing surface having the rope groove profile.

4. The method of claim 1, further comprising pressure forming the annular workpiece blank at a casing surface side by a main roll and by a mandrel roll that have a radial roll gap between them while rotating the annular workpiece blank about a blank axis of rotation.

5. The method of claim 4, further comprising pressure forming the annular workpiece blank at an end face side between at least one pair of axial rolls that have an axial roll gap between them.

6. The method of claim 5, further comprising using conical axial rolls that taper toward a center of the annular workpiece blank and are arranged in a common plane that passes through the main roll and the mandrel roll.

7. The method of claim 1, further comprising forming the end plates separately from the drum casing and subsequently joining the end plates to the drum casing, wherein the subsequently joining comprises screwing.

8. The method of claim 1, wherein the annular workpiece blank comprises a cast blank or is shaped in a mandrel roll step and/or a forge step from an initially hole-less blank.

* * * * *